US006223712B1

(12) United States Patent
Montgomery

(10) Patent No.: US 6,223,712 B1
(45) Date of Patent: May 1, 2001

(54) PERSONAL WATERCRAFT ENGINE

(76) Inventor: Robert E. Montgomery, 1560 Moonstone St., Brea, CA (US) 92621

( * ) Notice: Subject to any disclaimer, the term of this patent is extended or adjusted under 35 U.S.C. 154(b) by 0 days.

(21) Appl. No.: 09/420,922

(22) Filed: Oct. 19, 1999

(51) Int. Cl.[7] ..... F02F 7/00
(52) U.S. Cl. ..... 123/195 R; 440/84
(58) Field of Search ..... 123/195 R, 197.1; 440/84, 86

*Primary Examiner*—Noah P. Kamen

(74) *Attorney, Agent, or Firm*—Lynn & Lynn

(57) ABSTRACT

An internal combustion engine comprises a piston arranged to move reciprocally in a predetermined direction relative to an engine block. A drive shaft is mounted in the engine block and arranged to be driven by the piston in rotational motion about a first axis perpendicular to the direction of motion of the piston. Rotational motion of the drive shaft is transferred to a first shaft that is mounted in the engine block parallel to the drive shaft. Rotational motion of the first shaft is then transferred to a second shaft such that the engine produces a rotational output about an output axis that is parallel to the direction of reciprocal motion of the piston.

8 Claims, 6 Drawing Sheets

PERSONAL WATERCRAFT ENGINE

BACKGROUND OF THE INVENTION

This invention relates generally to internal combustion engines and particularly to an internal combustion engine suitable for use in propelling a personal watercraft. Still more particularly, this invention relates to an internal combustion engine and power transmission combination for a personal watercraft that a rider can steer by adjusting his stance and position thereon Previously available engine/transmission combinations for personal watercraft have height and width that are too large for use in a thin, light weight hull. Excessive height contributes to instability so that the hull has a tendency to roll, which causes difficulty in controlling the watercraft.

SUMMARY OF THE INVENTION

This invention provides a reciprocating piston engine that has a very small height so that the engine is suitable for use in applications having stringent height limitations. An engine/transmission system according to the present invention can include either a two-stroke or four-stroke engine.

The engine according to the present invention may be constructed to have a height of about 6.5 inches. The low height of the engine permits the fully assembled personal watercraft to have a lower center of gravity than was possible using previously available engines transmission combinations. The dimensions of the engine allow it to be mounted under the deck portion where the rider normally stands on a personal watercraft. This mounting location concentrates more weight near the desired axis about which the watercraft turns and allows the center of gravity of the watercraft to be under the rider, which allows the rider to turn the watercraft more easily and safely.

The engine drives a belt and gear that is used to make the engine provide an output that is parallel to the direction of motion of the piston. The engine output is therefore suitable for providing rotational energy to drive a jet pump to propel a personal watercraft.

An internal combustion engine according to the present invention comprises an engine block having a plurality of cylindrical passages therein. A piston is arranged to move reciprocally in a predetermined direction relative to the engine block. A drive shaft is mounted in a first one of the cylindrical passages in the engine block and connected to the piston and arranged to be driven by the piston in rotational motion about a first axis perpendicular to the direction of motion of the piston. The invention further includes means for transferring rotational motion of the drive shaft to a first shaft that is mounted in the engine block parallel to the drive shaft; and means for transferring rotational motion of the first shaft to a second shaft such that the engine produces a rotational output about an output axis that is parallel to the direction of reciprocal motion of the piston.

The means for transferring rotational motion of the drive shaft to the first shaft preferably includes a drive pulley mounted to the drive shaft for driving a belt and an output pulley mounted to the first shaft. The means for transferring rotational motion of the first shaft to the second shaft preferably includes a first gear mounted to the first shaft and a second gear mounted to the second shaft and arranged to mesh with the first gear and be driven in rotational motion thereby such that the engine provides a rotational output about an output axis that is parallel to the direction of reciprocal motion of the piston.

The engine according to the present invention preferably further comprises a rod connected to the piston and a first crankshaft assembly that includes a first crank, the drive shaft extending from the first crank and arranged to rotate concentrically therewith about the first axis, the first crank having a cylindrical cavity therein displaced laterally from the drive shaft. A second crankshaft assembly that includes a second crank and a crank pin is connected to the second crank arranged to extend through a passage in an end of the rod so that reciprocal motion of the piston moves the crank pin in circular motion. The crank pin is further arranged to extend into the cylindrical cavity in the first crank such that circular motion of the crank pin as the second crank rotates causes rotation of the first crank and the drive shaft.

The engine according to the present invention preferably further comprises a starter bendix mounted in a third passage in the engine block and a starter gear mounted to the drive shaft adjacent the starter bendix. A starter motor is mounted to the starter bendix and arranged such that application of electrical power to the starter motor causes rotation of the starter bendix, the starter gear and the drive shaft to start the engine.

An appreciation of the objectives of the present invention and a more complete understanding of its structure and method of operation may be had by studying the following description of the preferred embodiment and by referring to the accompanying drawings.

DETAILED DESCRIPTION OF THE INVENTION

Figures 1, 2:
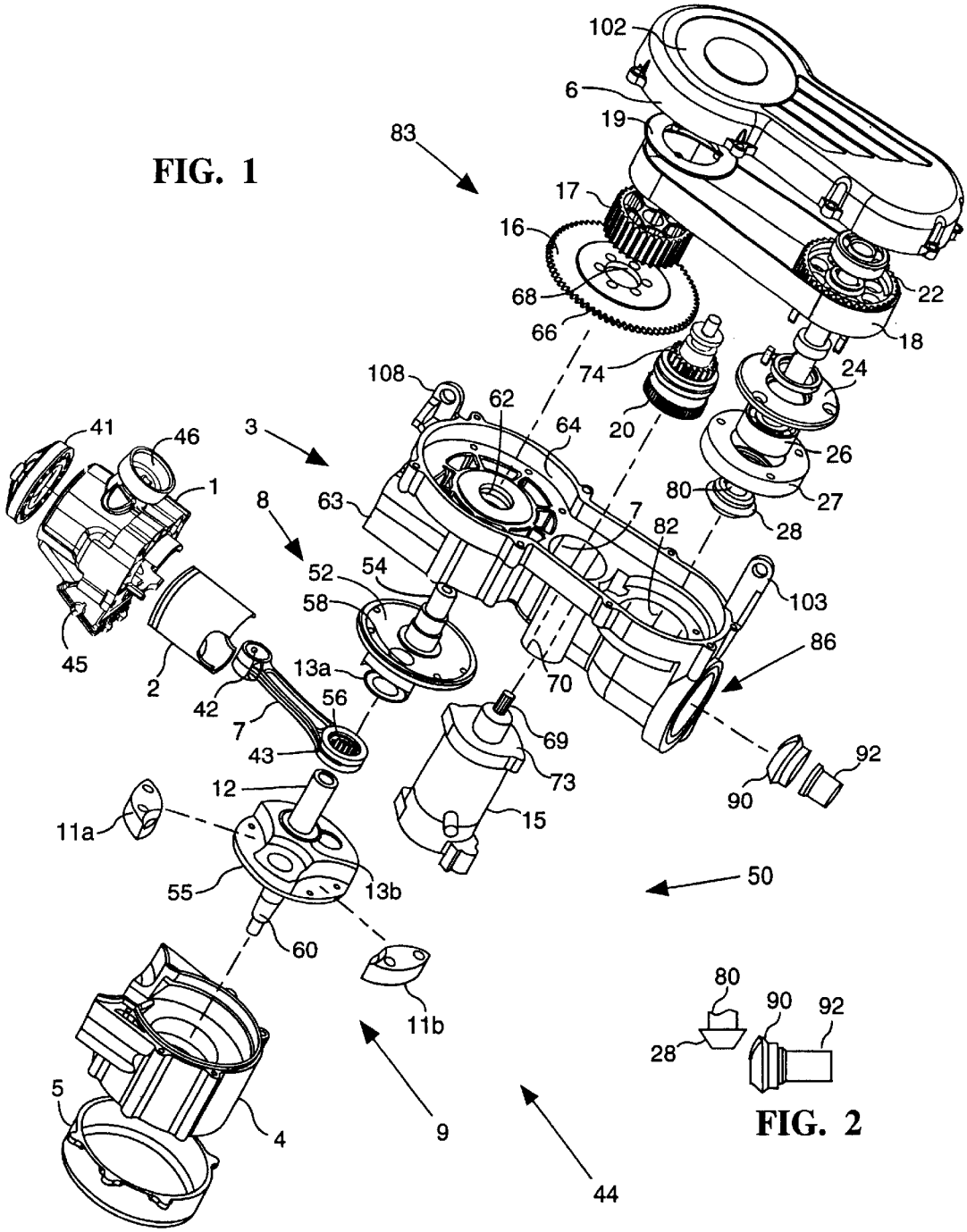
FIG. 1 is an exploded perspective view of an internal combustion engine according to the invention.
FIG. 2 is an elevation view showing transmission of the engine output to a drive shaft that is parallel to the axis of movement of a piston included in the engine of FIG. 1.
Figure 3:
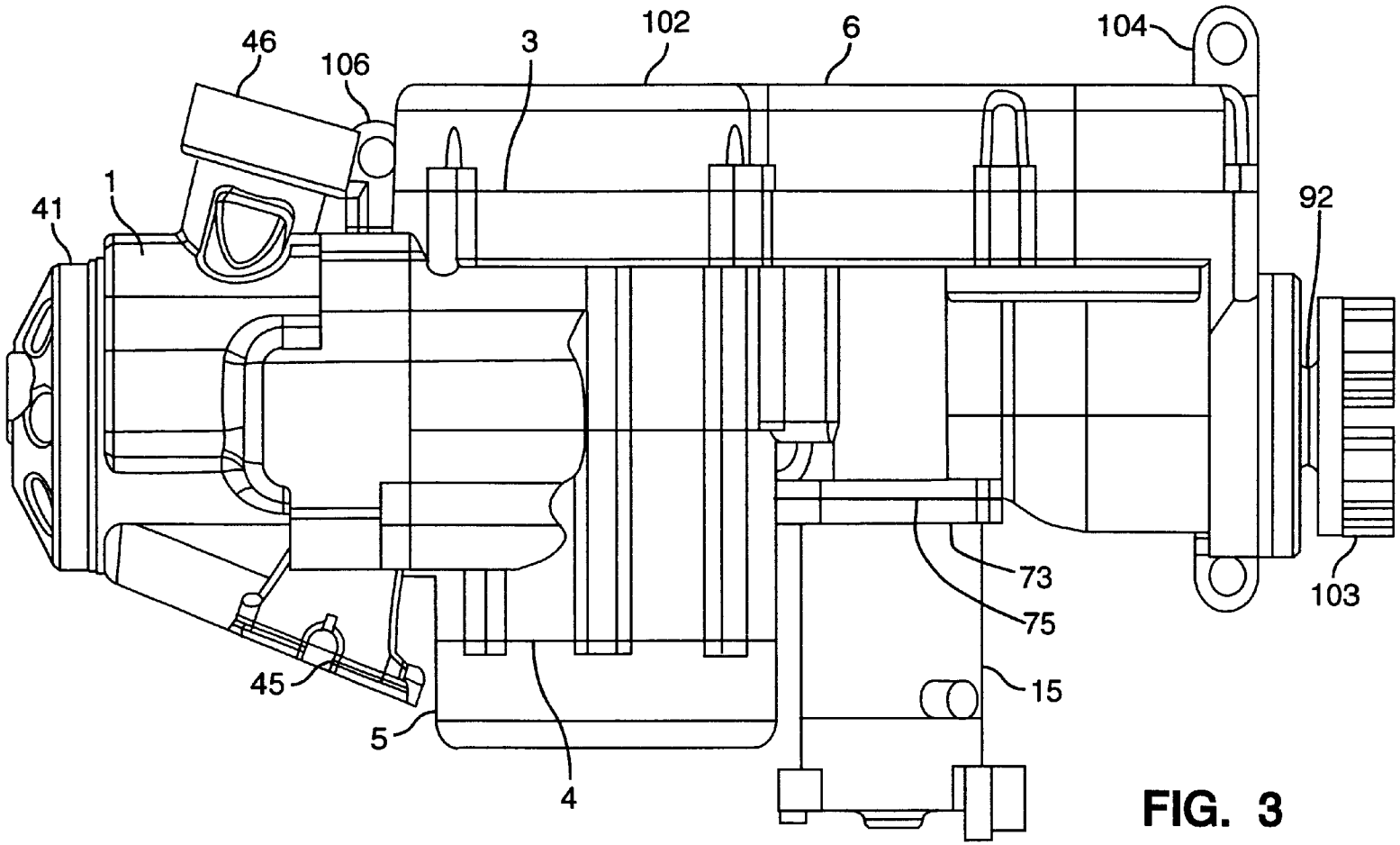
FIG. 3 is a left side elevation view of the internal combustion engine of FIG. 1.
Figure 4:
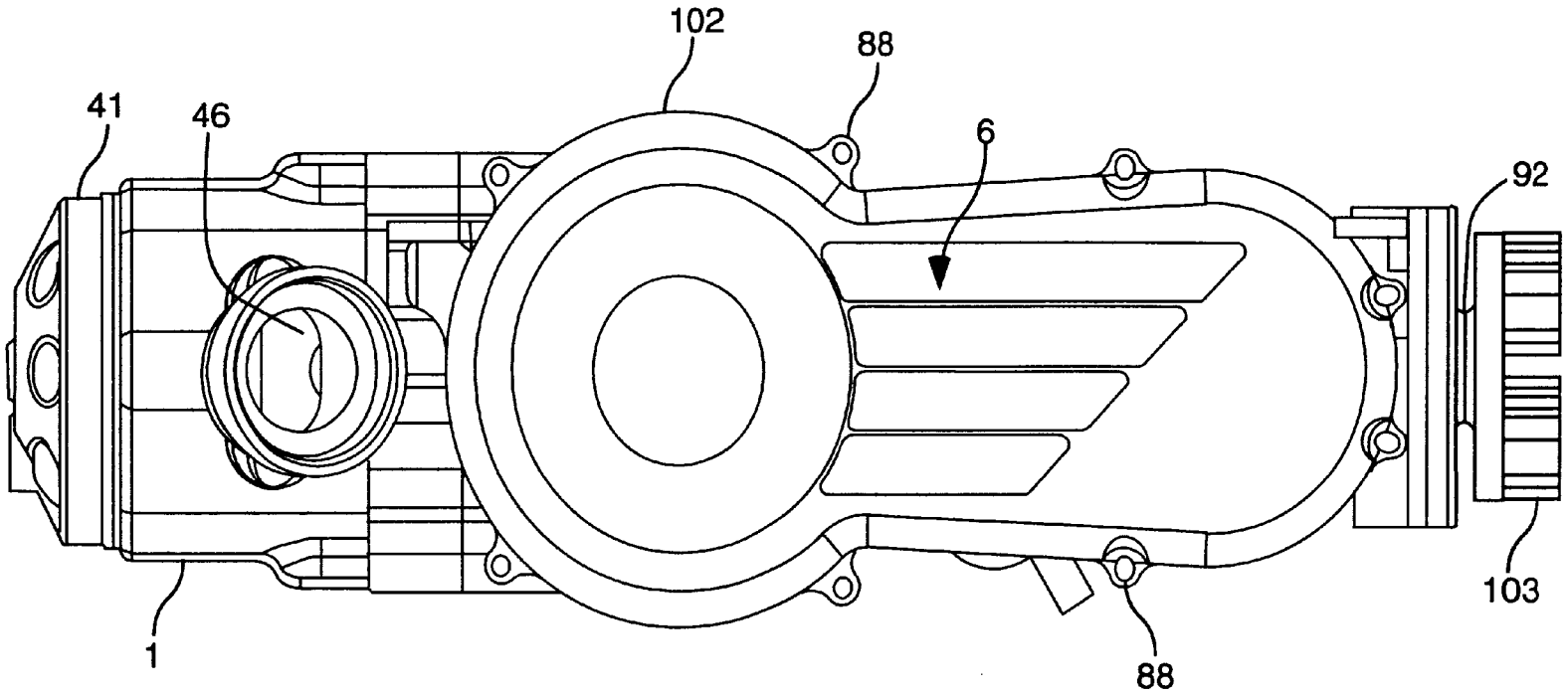
FIG. 4 is a top plan view of the internal combustion engine of FIGS. 1 and 3.
Figure 6:
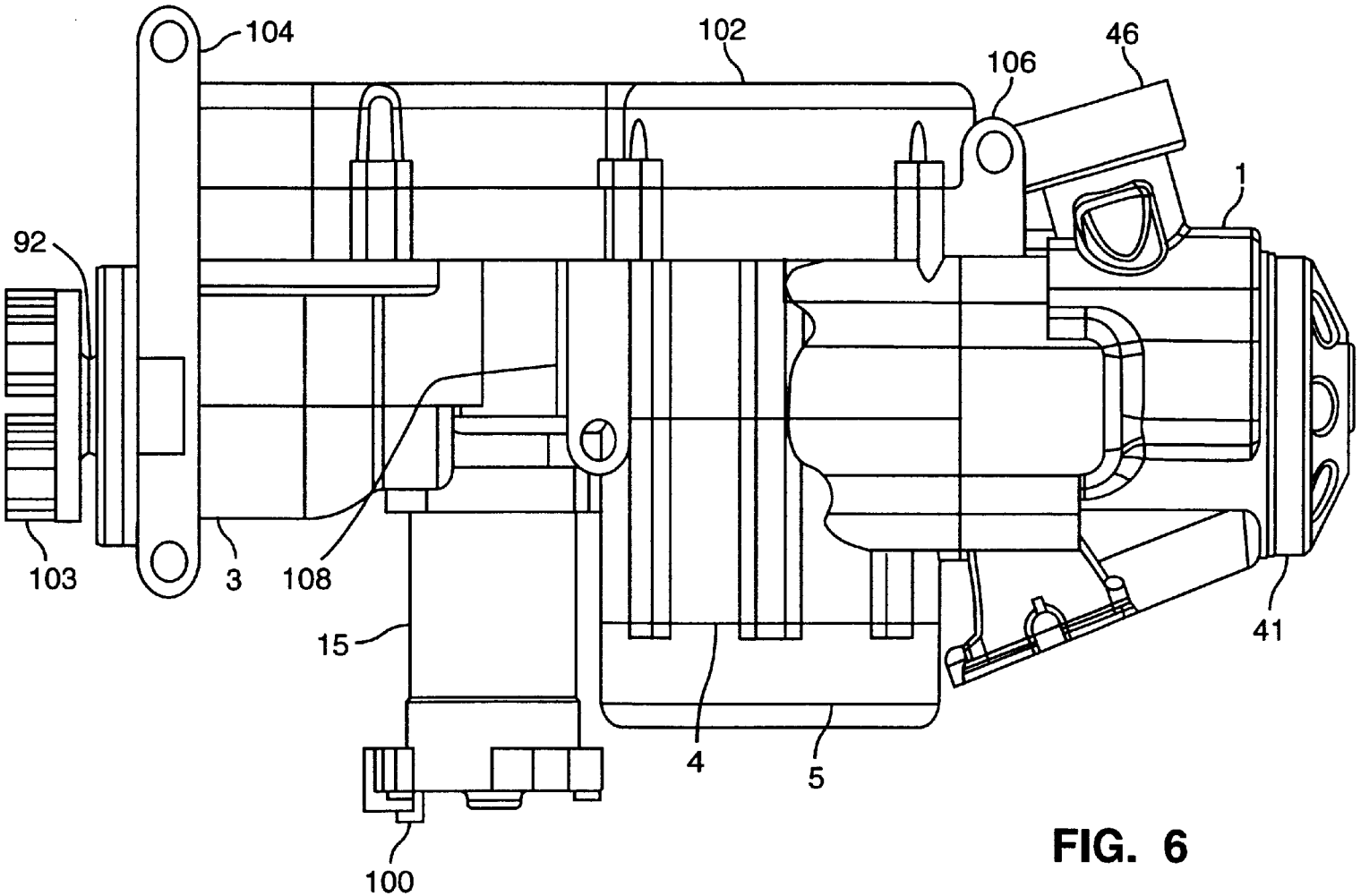
FIG. 6 is a right side elevation view of the internal combustion engine according to the present invention.

This invention is an internal combustion engine 44 as shown in the exploded perspective view of FIG. 1. The engine 44 is designed to be have a very small height as shown in FIGS. 3 and 6 so as to be suitable for use in applications having stringent vertical space limitations. In particular, the engine 44 is designed to be suitable for use in personal watercraft such as those disclosed in the following-listed U.S. patents to Robert E. Montgomery, a joint inventor of the present invention: U.S. Pat. No. Des. 334,552, issued Apr. 6, 1993, U.S. Pat. No. Des. 355,400, issued Feb. 14, 1995 and U.S. Pat. No. 5,582,529, issued Dec. 10, 1996. The disclosures of U.S. Pat. No. Des. 334,552, U.S. Pat. No. Des. 355,400 and U.S. Pat. No. 5,582,529 are hereby incorporated by reference into the present disclosure.

As shown in FIGS. 1 and 3–6, the engine 44 according to the present invention includes a cylinder housing 1 that houses a piston 2. A first end of the cylinder housing 1 is sealed by a cylinder head 41 and an appropriate head gasket (not shown) in accordance with standard practice in the art. The cylinder head 41 also includes a hole (not shown) for mounting a spark plug (not shown) in accordance with standard practice in the art. The cylinder housing 1 includes an intake port 45 and an exhaust port 46. Unlike conventional engines, the intake port 45 and the exhaust port 46 are on opposite sides of the cylinder housing 1. A conventional arrangement typically has the intake and exhaust ports located in-line with the cylinder 2. The arrangement of the intake port 45 and the exhaust port 46 helps achieve the goal of making the dimensions of the engine 44 be as small as possible.

As shown in FIG. 1, the piston 2 is mounted to a first end 42 of a rod 7 in a conventional manner. A suitable needle bearing (not shown) may be mounted in a hole 47 in the first end of the rod 7 to minimize friction. The other end 43 of the rod 7 is mounted to a crankshaft assembly 50 that includes a right half 8 and a left half 9. The right crankshaft half 8 includes a right crank wheel 52 and a drive shaft 54 that extends outward from the center of the right crank wheel 52. The left half 9 of the crankshaft assembly 50 includes a left crank wheel 9 having a crank pin 12 extending therefrom. The crank pin 12 is located eccentrically on the left crank 55 and is arranged to extend through a hole 56 in the second end 43 of the rod 7 into a hole 58 in the right crank wheel 52. The hole 58 is eccentrically located in the crank wheel 52 and is displaced laterally from the drive shaft 54.

A needle bearing 14 may be used to reduce friction between the crank pin 12 and the rod 7. A pair of axial washers 13*a* and 13*b* may be mounted on the crank pin 12 to provide a predetermined space between the rod 7 and the right and left crankshaft halves 8 and 9, respectively.

The crank pin 12 extends outwardly from a first side of the generally cylindrical left crank wheel 9. A second pin 60 extends from the center of the other side of the left crank wheel 9 into a crankcase housing 4. The left crank wheel 9 is arranged to be mounted inside the crankcase housing 4 and to rotate about the axially aligned pin 60. The second pin 60 is mounted in the crankcase housing 4 to provide a fixed axis of rotation for the left crank wheel 9. A flywheel (not shown) may be mounted to the pin 60. The crankcase housing 4 is sealed by a flywheel cover 5.

When the engine 44 is assembled, the piston housing 1 is connected to an end 83 of the engine block 3. The crankcase housing 4 is mounted to the lower side 65 of the engine block 3.

Reciprocal movement of the piston 2 in the cylinder 1 moves the crank pin 12 in a circle, which causes rotation of the left crank wheel 9 about its central axis defined by the pin 60. The circular movement of the crank pin 12 while it is extending into the hole 58 causes rotational movement of the right crank wheel 52 about its central axis defined by the drive shaft 54, rotates with the right crank wheel 52. This arrangement allows the piston 2 to move reciprocally in the cylinder housing 1 and thereby produce rotational movement of the right and left crankshaft assemblies 8 and 9. The axis of rotation of the right and left crankshaft assemblies 8 and 9 is perpendicular to the direction of reciprocal movement of the piston 2 in the cylinder housing 1, which is a conventional feature of reciprocating engine structures.

Referring again to FIG. 1, a pair of balance weights 11*a* and 11*b* may be mounted to the left crank wheel 9. In similar fashion, a pair of balance weights (not shown) may be mounted to the right crank wheel 52.

Figure 5:
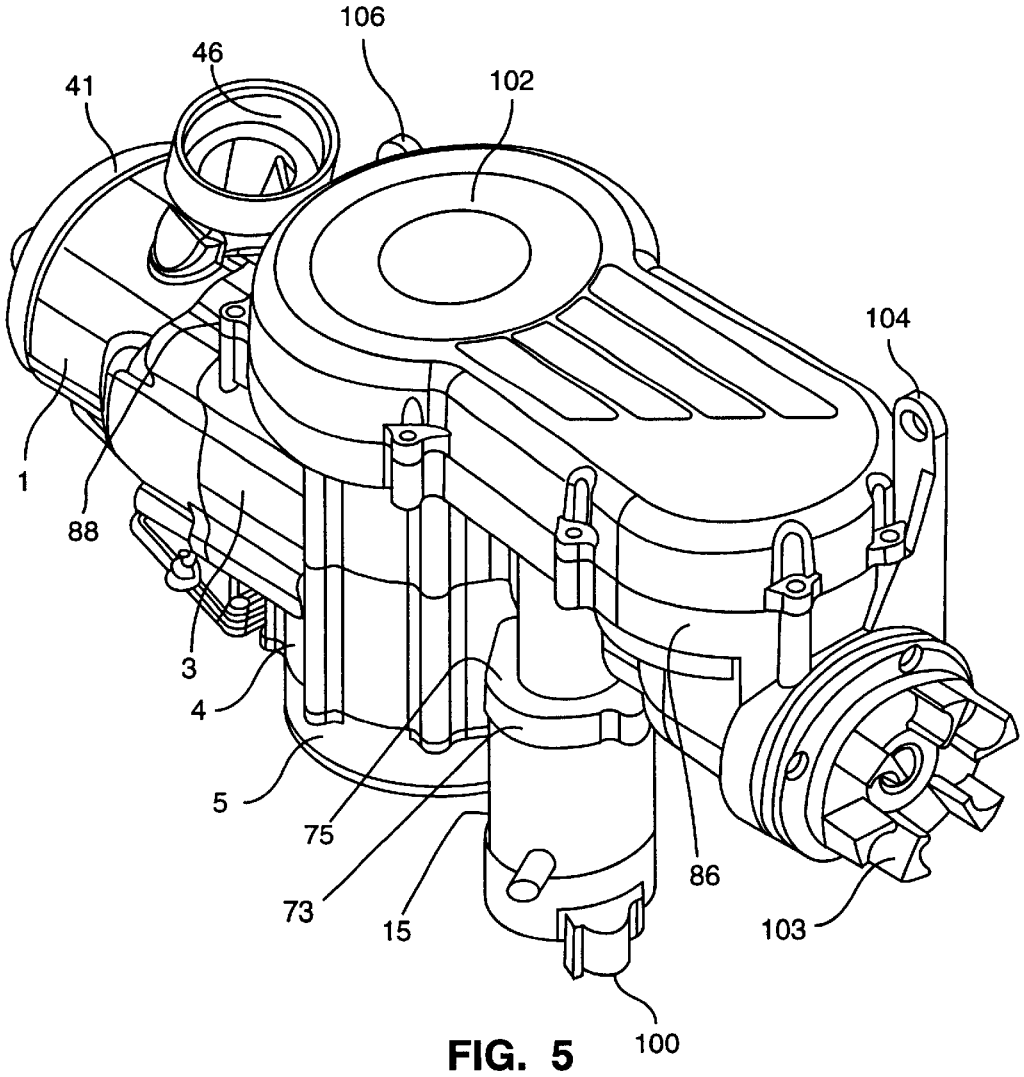
FIG. 5 is a perspective view showing the top and left sides and the right end of the internal combustion engine according to the present invention.

A starter gear 16 is mounted in a cylindrical recess 64 in the engine block 3. The starter gear 16 is a thin cylindrical structure having gear teeth 66 formed on its outer rim. The drive shaft 54 extends through a hole 68 in the center of the starter gear 16. A starter motor 15 has an output shaft 69 arranged to extend through a cylindrical passage 70 in the engine block 3. As best shown in FIGS. 3 and 5, a flange 73 on the starter motor 15 is connected to a similar flange 75 on the lower side of the engine block 3 when the motor 44 is fully assembled.

A starter bendix 20 is arranged to be mounted in a recess 72 in the engine block 3 and connected to the starter output shaft 69. The bendix has gear teeth 74 that engage the starter gear teeth 66 upon application of electrical power to the starter motor 15. Rotation of the starter output shaft 69 is thus transmitted to the starter gear 16 to the crankshaft assembly 50, which in turn causes the piston 2 to move and start the engine 44.

The drive shaft 54 is arranged to extend into a cylindrical hole 62 near an end 63 of the engine block 3 when the engine 44 is assembled. The drive shaft 54 extends through the starter gear 16, and a drive pulley 17 is mounted to the end of the drive shaft 54. A belt guide 19 is mounted to the drive pulley 17 so that the sides of a drive belt 18 mounted on the drive pulley 17 are between the starter gear 16 and the belt guide 19. A rear pulley 22 is mounted to a shaft 80 that is mounted in the engine block 3. A seal 24 is mounted on the shaft 80 between the rear pulley 22 and a bearing housing cover 25. A bearing 26 is arranged to be mounted inside a bearing housing 27. The bearing housing 27 is arranged to mounted in a cylindrical recess 82 in the engine block 3.

The arrangement of the pulleys 17 and 22 and the belt 18 is convenient for providing means for transferring the output of the engine 44 from the pin 54 to the parallel shaft 80. The combination of the drive pulley 17, the rear pulley 22 and the belt 18 allows flexibility in adjusting the torque transmitted to the shaft 80. The drive shaft 54, the drive pulley, drive belt 18, rear pulley 22, shaft 80, gear 82 and gear 80 comprise a transmission 83, However, the invention 83 is not limited to the pulley and belt combination shown in the drawings and described above. For example, instead of pulleys 17 and 22 and belt 18, the invention may include a gear driven apparatus (not shown). For example, the transmission may include a first pair of bevel gears (not shown) mounted to the pin 54 and to the shaft 80, respectively. A shaft (not shown) carrying a second pair of bevel gears (not shown) meshed with the first pair of bevel gears may be mounted in the block 3 to transfer the engine output from the pin 54 to the parallel shaft 80.

A gear 28 is arranged to be mounted to the end of the shaft 80. Operation of the engine 44 causes rotation of the drive pulley 17, which then drives the belt 18. The belt 18 drives the rear pulley 22, which causes the shaft 80 to rotate. The shaft 80 is parallel to the drive shaft 54. A cylindrical hole 84 is formed in the other end 86 of the engine block 3. The hole 84 is perpendicular to the axis of the shaft 80 and parallel to the direction of reciprocal movement of the piston 2 in the cylinder housing. A gear 90 is arranged to extend into the hole 84. As shown in FIG. 2, the gear 90 meshes with the gear 28 so that rotation of the gear 28 is transferred to the gear 90 and to an output shaft 92 that is connected to the gear 90. In the embodiment shown in FIGS. 1 and 2, the gears 28 and 90 are bevel gears. The drive pulley, drive belt 18 and rear pulley 22 are located in a recess 85 in the upper portion of the engine block 3 when the engine 44 is fully assembled. A transmission cover 6 is secured to the engine block 3 by means of suitable bolts 88 secured in threaded recesses (not shown) in a manner well-known in the art.

In particular, the engine has a rotational speed that typically is in the range of about 7500 to 9000 rpm where the power output is at a maximum. Typical piston displacements range from about 200 cc to 550 cc, which produce maximum power of about 25 to 65 hp, respectively, in a two-stroke configuration. In marine applications the engine 44 is may be used to drive a jet pump 110 as shown schematically in FIG. 7. A typical jet pump suitable for such applications operates at maximum efficiency at rotational speeds in the range of 3000 to 4000 rpm. The diameters of the drive pulley 17 and the rear pulley 22 may selected to have a ratio that allows the engine 44 to operate at the speed for peak power output while at the same time driving the output shaft 92 at the speed required to operate the jet pump (or other device attached to the output shaft 92) at its peak efficiency. The diameters of the drive pulley 17 and the rear pulley 22 may selected to have a ratio that allows the engine 44 to operate at the speed for peak torque output while the jet pump operates at a speed to provide maximum efficiency.

The structure of the engine 44 lends itself to easy adaptation to match it to the device to be driven. All that is required is to remove the transmission cover 6 and the pulleys 17 and 22 and replace them with pulleys having the appropriate diameter ratio and a belt 18 of the appropriate length for the selected pulley diameters.

Figure 7:
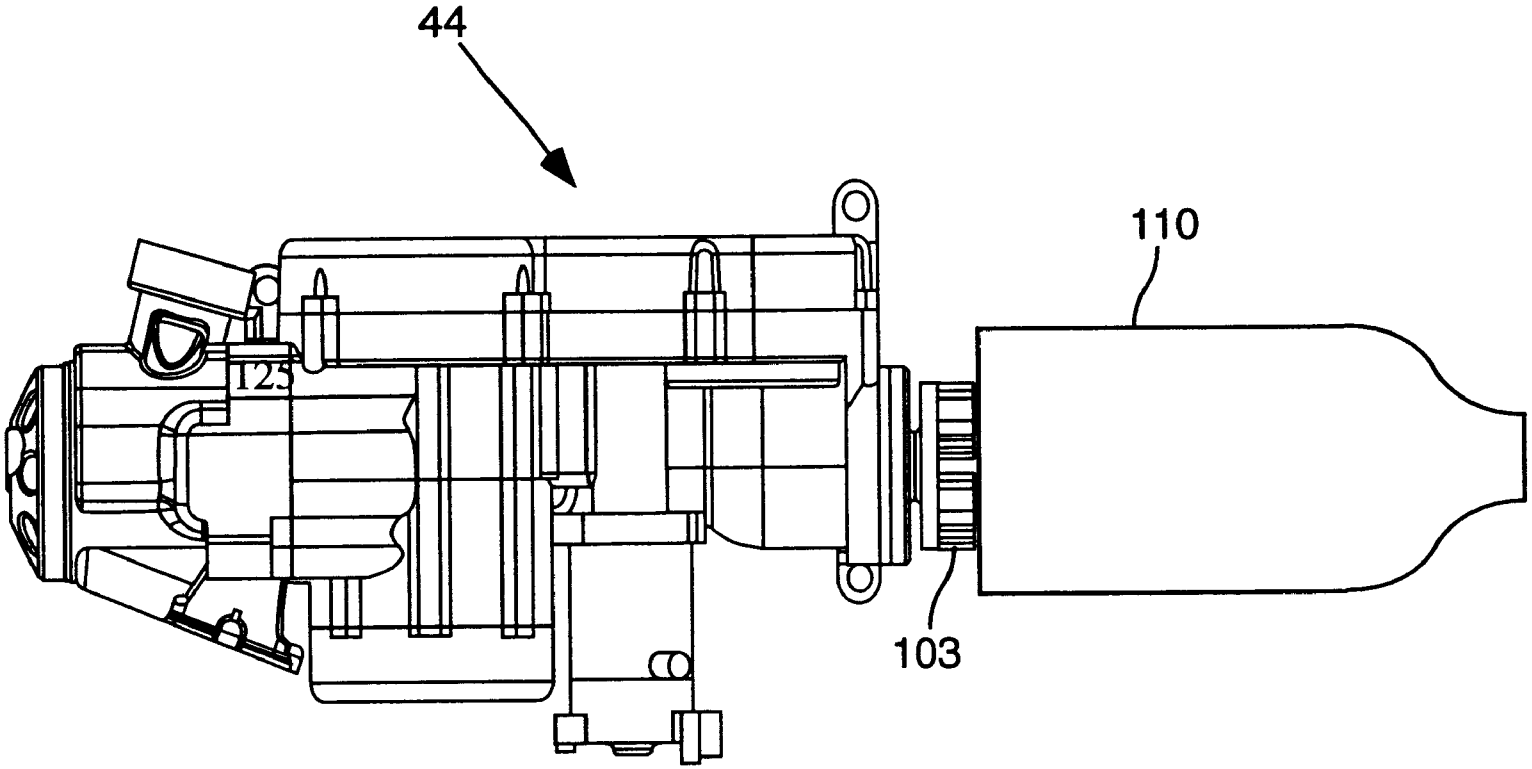
FIG. 7 schematically illustrates the engine of FIGS. 1–6 connected to a jet pump to propel a watercraft.

FIGS. 3–7 show a coupling 103 connected to the output end of the shaft 92. The coupling 103 is designed for connecting the output of the engine 44 to a jet pump (not shown) or other apparatus to be driven by the engine 44. The engine 44 is preferably connected to a jet pump 110 via the coupling 103 as shown in FIG. 7 with the shaft output 92 aligned end-to-end with the jet pump. The engine 44 is arranged to drive the jet pump in the manner disclosed in U.S. Pat. No. 5,582,529. Brackets 104, 106 and 108 are connected to the engine block 3 to provide means for mounting the engine 44 in the engine bay (not shown) of a personal watercraft or other device in which the engine 44 to be used.

The invention is not limited to the particular structure of the transmission 83 shown and described herein. Any rotary power transfer assembly that transmits rotation energy from the drive shaft 54 to the perpendicular shaft 92 is included in the scope of the invention. The basic features of the invention may be incorporated into both two stroke and four stroke versions of the engine.

The shaft 92 is preferably parallel to the direction of movement of the piston 2 in the cylinder housing 1. Therefore, the axis of rotation of the output of the engine 44 is parallel to the direction of movement of the piston 2 in the engine. This feature allows the engine 44 to have a small height so that it can be used in a low-profile application such as a motorized water ski. As used herein, "height" means the distance from the lowermost portion edge 100 of the starter motor 15 to the upper edge 102 of the transmission cover 6. In an embodiment of the engine having a piston displacement of approximately 250 to 550 cc producing a power output of 25 to 65 hp, the engine height is typically about 6.5 inches. The engine 44 is typically about 10 inches wide and 21 inches long.

What is claimed is:

1. An internal combustion engine, comprising:

an engine block having a plurality of cylindrical passages therein;

a piston arranged to move reciprocally in a predetermined direction relative to the engine block;

a drive shaft mounted in a first one of the cylindrical passages in the engine block and connected to the piston and arranged to be driven by the piston in rotational motion about a first axis perpendicular to the direction of motion of the piston;

a drive pulley mounted to the drive shaft;

a belt mounted to the drive pulley;

a pulley shaft mounted in a second cylindrical passage in the engine block;

an output pulley mounted to a first end of the pulley shaft and arranged to be driven by the belt;

a first gear mounted to a second end of the pulley shaft such that the first gear and the pulley shaft have concentric axes of rotation;

a second gear arranged to mesh with the first gear and be driven in rotational motion thereby such that the engine produces a rotational output about an output axis that is parallel to the direction of reciprocal motion of the piston.

2. The internal combustion engine of claim 1, further comprising:

a rod connected to the piston;

a first crankshaft assembly that includes a first crank, the drive shaft extending from the first crank and arranged to rotate concentrically therewith about the first axis, the first crank having a cylindrical cavity therein displaced laterally from the drive shaft; and a second crankshaft assembly that includes a second crank and a crank pin connected to the second crank arranged to extend through a passage in an end of the rod so that reciprocal motion of the piston moves the crank pin in circular motion, the crank pin being further arranged to extend into the cylindrical cavity in the first crank such that circular motion of the crank pin as the second crank rotates causes rotation of the first crank and the drive shaft.

3. The internal combustion engine of claim 1 including a cylinder housing mounted to the engine block and arranged to house the piston, the cylinder housing including an intake port and exhaust port located on opposite side of the cylinder housing.

4. A system for propelling a watercraft, comprising:

an internal combustion engine block having a plurality of cylindrical passages therein;

a piston arranged to move reciprocally in a predetermined direction relative to the engine block;

a drive shaft mounted in a first one of the cylindrical passages in the engine block and connected to the piston and arranged to be driven by the piston in rotational motion about a first axis perpendicular to the direction of motion of the piston;

a drive pulley mounted to the drive shaft;

a belt mounted to the drive pulley;

a pulley shaft mounted in a second cylindrical passage in the engine block;

an output pulley mounted to a first end of the pulley shaft and arranged to be driven by the belt;

a first gear mounted to a second end of the pulley shaft such that the first gear and the pulley shaft have concentric axes of rotation;

a second gear arranged to mesh with the first gear and be driven in rotational motion thereby such that the engine produces a rotational output about an output axis that is parallel to the direction of reciprocal motion of the piston;

an output shaft connected to the second gear to be driven in rotational motion about the output axis; and a jet pump connected to the output shaft to be driven thereby, the drive pulley and the output pulley having diameters such that when the engine operates at a selected speed, the jet pump operates at its peak efficiency.

5. The system for propelling a watercraft of claim 4 wherein the engine operates at speed that produces maximum torque output when the jet pump is operating at its maximum efficiency.

6. The system for propelling a watercraft of claim 4 wherein the engine operates at speed that produces maximum power output when the jet pump is operating at its maximum efficiency.

7. The system for propelling a watercraft of claim 4, further comprising:

a rod connected to the piston;

a first crankshaft assembly that includes a first crank, the drive shaft extending from the first crank and arranged to rotate concentrically therewith about the first axis, the first crank having a cylindrical cavity therein displaced laterally from the drive shaft; and a second crankshaft assembly that includes a second crank and a crank pin connected to the second crank arranged to extend through a passage in an end of the rod so that reciprocal motion of the piston moves the crank pin in circular motion, the crank pin being further arranged to extend into the cylindrical cavity in the first crank such that circular motion of the crank pin as the second crank rotates causes rotation of the first crank and the drive shaft.

8. The system for propelling a watercraft of claim 4, further comprising a cylinder housing mounted to the engine block and arranged to house the piston, the cylinder housing including an intake port and exhaust port located on opposite side of the cylinder housing.

* * * * *